United States Patent [19]

Huckaby

[11] 4,274,490

[45] Jun. 23, 1981

[54] INTERNAL FLUID CONTROL VALVE FOR USE IN OIL WELL REMEDIAL OPERATIONS

[76] Inventor: Leonard Huckaby, P.O. Box 152, Wayne, Okla. 73095

[21] Appl. No.: 74,968

[22] Filed: Sep. 13, 1979

[51] Int. Cl.[3] ..... E21B 34/08

[52] U.S. Cl. ..... 166/325; 137/509

[58] Field of Search ..... 166/325; 137/509

[56] References Cited

U.S. PATENT DOCUMENTS

| | | | |
|---|---|---|---|
| 480,528 | 8/1892 | Thoms | 137/509 |
| 3,106,932 | 10/1963 | Chsholm | 166/322 X |
| 4,063,594 | 12/1977 | Canterbury | 166/325 |

*Primary Examiner*—Ernest R. Purser

*Attorney, Agent, or Firm*—Ralph B. Pastoriza

[57] ABSTRACT

In oil well remedial operations, a powerful generally acidic solution is pumped down a pipestring and out into the well annulus at the level of casing perforations wherein the solution will pass through the perforations and clean them out to facilitate oil flow into the annulus for subsequent recovery. When increasing the depth of the pipe string as by adding further pipe sections at the surface of the well, it is desirable to retain the solution within the pipe string and towards this end, there is provided an internal fluid control valve normally closed to retain fluid but responsive to an increase in the fluid pressure above a given value to open and permit the treating fluid to pass into the annulus and treat the casing perforations. Basically the internal valve comprises a valve seat and ball, the ball being positioned on the upstream side of the valve so that should any seals fail in the valve structure, the valve will failsafe to a closed position.

5 Claims, 2 Drawing Figures

INTERNAL FLUID CONTROL VALVE FOR USE IN OIL WELL REMEDIAL OPERATIONS

This invention relates generally to oil well systems and more particularly to an improved internal control valve for use in oil well remedial operations.

BACKGROUND OF THE INVENTION

Oil recovery in producing wells is oftentimes impeded because of a tendency for the casing perforations through which oil passes into the well annulus to become clogged or otherwise damaged. This problem can be remedied to a certain extend by treating the perforations with a highly caustic liquid treating fluid. This fluid is introduced into the well annulus adjacent to the perforations by a pipe string extending from the surface of the well through which the treating fluid is passed. Since perforations occur at various different depths in different wells, or even in the same well, treatment may take place at a certain level and then it becomes necessary to add further pipe sections to the pipe string to effect treatment at lower levels. During the connection or disconnection of such pipes, it is essential that the fluid be retained in the pipe string not only from a safety standpoint but simply to avoid wasting the treating fluid.

With the above in mind, it is the practice to introduce into the pipe string an appropriate control valve which might constitute an entire sub section simply substituted for one of the pipe sections in the string. Basically, the control valve must be operable in response to a predetermined application of hydraulic force in order that the same can be controlled from the surface. Accordingly, conventional valves of which I am aware all incorporate a valve seat and ball seated on the downstream side of the valve seat. The ball in turn is biased into closed condition on the valve seat by an appropriate compression spring.

With the foregoing arrangement, it is only necessary to provide a hydraulic force on the ball to oppose the force of the spring and thereby unseat the ball and open the valve. The caustic treating fluid can then pass through the valve to the well annulus to treat the perforations.

One problem with the foregoing types of valves is the fact that should the spring fail so that the ball is not held on the seat, the valve fails open, and thus all fluid will drain. Another problem is the fact that once the hydraulic pressure of the treating fluid is increased sufficiently to overcome the spring pressure and thereby unseat the valve, initial flow of fluid through the valve will result in a drop in pressure across the valve. The spring will then reseat the valve and pressure will build up and then unseat the ball and a "chattering" situation can exist.

In addition to the foregoing, many prior art control valves for the purposes set forth constitute entire sub assemblies which are to be substituted within the pipe string for one of the pipe sections. Should the valve sub body be of larger diameter than the pipe string, it constitutes a hazard in possibly causing a "hang-up".

BRIEF DESCRIPTION OF THE PRESENT INVENTION

With the foregoing in mind, the present invention contemplates the provision of a greatly improved internal type fluid control valve for use in oil well remedial operations overcoming the aforementioned specific problems with prior art valves.

More particularly, the control valve of this invention includes an adapter collar for insertion between the lower end of one pipe section and the upper end of the next normally provided pipe section in a pipe string through which treating fluid is to be passed. This adapter includes a central reduced diameter bore for receiving the lower end of a valve barrel of smaller diameter than the pipe string arranged to be coaxially received within a pipe section to the lower end of which the adapter is secured. A valve seat is provided in the lower end of the barrel facing upwardly and a ball in turn is positioned on this valve seat on the upstream side of fluid flow through the valve seat and reduced diameter portion of the adapter to the lower pipe string sections. Means are provided in the barrel responsive to hydraulic pressure of treating fluid to lift the ball from the valve seat when a predetermined pressure has been exceeded and thus open the valve to allow the treating fluid to pass out the end of the pipe string to the various perforations. When the pressure is relieved, the ball will seat on the valve seat. The arrangement is such that should a failure occur in any of the parts of the valve, the ball will automatically seat on the seat and be held there by hydraulic pressure so that a "failsafe" condition exists. Moreover, the means responsive to the hydraulic pressure is such that once the valve ball is lifted from the seat, it snaps open to a fully open position in the manner of a toggle type action so that unimpeded uniform flow of fluid can be realized so long as the desired pressure is maintained. Finally, the design of the adapter for coaxially supporting the valve barrel wholly within one of the pipe sections provides for an internal valve completely protected from the environment and which will not increase the diameter of the pipe string.

BRIEF DESCRIPTION OF THE DRAWINGS

A better understanding of this invention as well as various further features and advantages thereof will be had by now referring to a preferred embodiment thereof as illustrated in the accompanying drawings in which.

DETAILED DESCRIPTION OF THE PREFERRED EMBODIMENT

Figure 1:
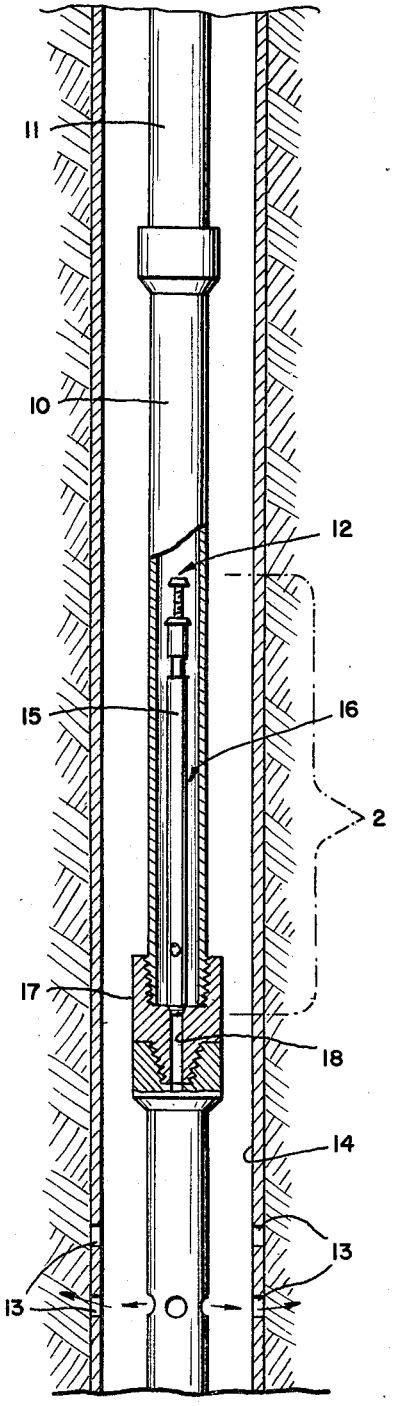
FIG. 1 is a cross section of an oil well bore hole incorporating a pipe string through which treating fluid is to be passed and wherein the valve of the present invention is utilized; and, FIG. 2 is a greatly enlarged cross section with certain components shown in full lines of the portion of the valve and pipe string encompassed within the dashed bracket 2 of FIG. 1.

Referring first to FIG. 1, there is shown a pipe section 10 constituting part of a pipe string 11 through which a treating fluid 12 is passed for treating the well casing perforations through which oil passes.

These perforations are indicated at 13 in the well casing 14, there being provided lateral openings in the lower end of the pipe string through which the treating fluid 12 passes, all as indicated by the arrows.

In order to retain the fluid 12 in the pipe string 11 when adding a further pipe section or in manipulating the pipe string to a different level wherein it is not desired to have the treating fluid flow out the end of the pipe string, an appropriate internal control valve is provided. In accord with the present invention, the control valve is illustrated in the cut-away portion of FIG. 1 within the pipe section 10 and includes an elongated valve barrel 15 of a diameter to be coaxially received within the pipe section 10 and define an annulus 16 between the inner wall of the pipe section and the outer wall of the barrel as shown. An adapter collar 17 is threadedly receivable between the lower end of the pipe section 10 and the upper end of the next normally provided pipe section in the string. This adapter has a central reduced diameter bore 18 tapered at its upper end to receive and support the lower end of the valve barrel 15. It will be appreciated that the adapter 17 closes off the lower end of the annulus 16, the valve passing the fluid 12 from the annulus through appropriate side openings in the valve barrel 15 and thence downwardly through the reduced diameter bore 18 all as will now become clearer by referring to FIG. 2.

Figure 2:
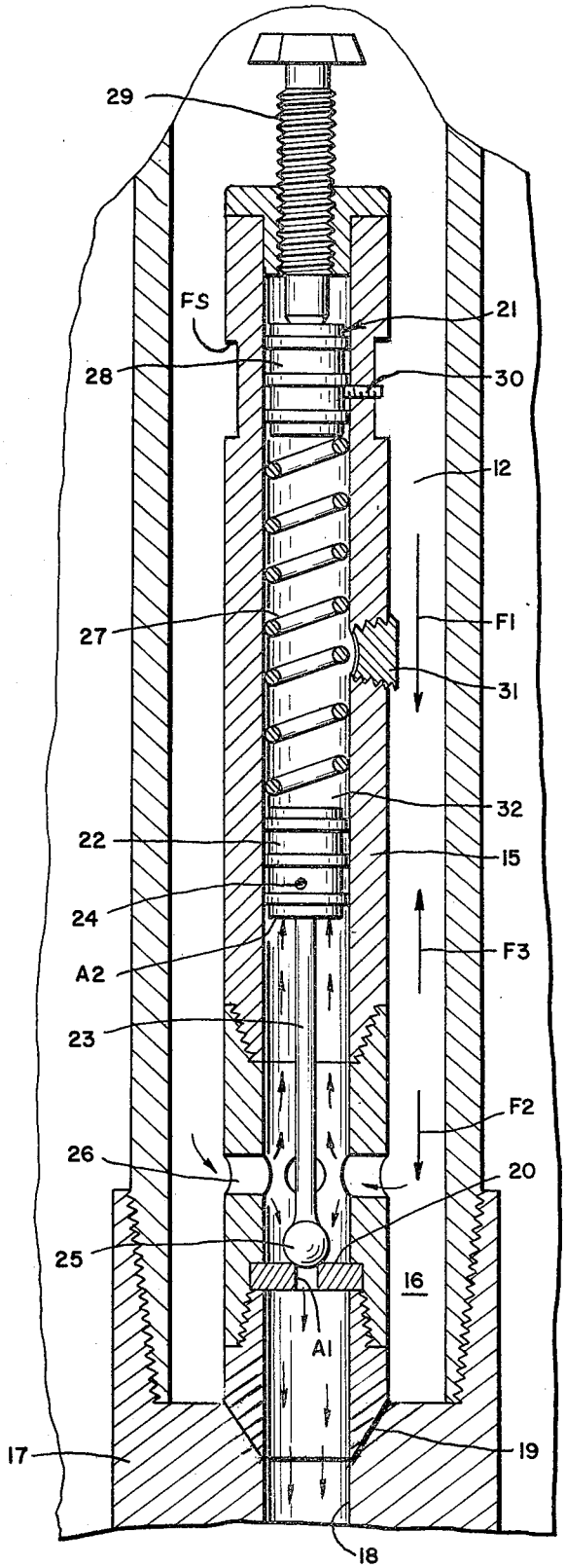

Referring first to the lower portion of FIG. 2, the tapered portion of the adapter 17 seating the lower end of the valve barrel 15 is indicated at 19. Within the lower portion of the valve barrel there is provided a valve seat 20 facing upwardly as shown and having a lower portion in communication with the reduced diameter central bore 18 in the adapter 17.

Referring now to the upper portion of the valve barrel 15, there is provided a stop means 21. Below the stop means 21 at an intermediate portion of the valve barrel there is provided a piston 22 disposed above the valve seat 20 as shown and having a piston rod 23 connected at 24 at its upper end to the piston 22 and extending downwardly to terminate in a ball 25 for seating on the valve seat 20. The cross sectional area of the valve seat 20 is indicated at A1 and is less than the cross sectional area A2 of the underside of the piston 22. The valve barrel 15 is provided with side openings between the ball and valve seat and underside of the piston 22 as shown in FIG. 2 in communication with the annulus 16. It will be clear that when the ball 25 is seated on the valve seat 20, communication is blocked between the annulus 16 and the reduced diameter bore 18 in the lower portion of the adapter. When the ball is unseated, fluid in the annulus 16 can pass through the side openings 26 and the valve seat to the lower pipe sections of the pipe string.

Since the area A2 is larger than the area A1, the hydraulic pressure of fluid in the annulus 16 is communicated through the openings 26 to the underside of the piston tending to lift the ball 25 from the valve seat. This force, however, is opposed by the provision of a powerful compression spring 27 disposed between the stop means 21 and the upper side of the piston 22 in the valve barrel. In the particular embodiment of the valve shown in FIG. 2, the stop means 21 preferably includes an additional piston 28 sealing the upper end of the valve barrel from communication with the annulus 16, together with a threaded member 29 received in the upper end of the valve barrel and bearing against the additional piston 28. The position of the stop means can thus be adjusted to change the force that the compression spring exerts on the first mentioned piston 22. Once a desired adjustment has been made, the additional piston 28 constituting the stop means is secured in its adjusted position as by a set screw 30 passing into the side of the valve barrel 15.

Since the additional piston 28 cooperating with the first mentioned piston 22 provides a sealed area for the spring 27, it is possible to introduce a transmission like oil fluid for lubricating the O-rings on the movable piston 22. Such fluid can be introduced by providing a removable plug 31 in the side of the valve barrel 15 and pouring in approximately 50 cc of such fluid. This fluid is indicated at 32 on the upper side of the piston 22 in FIG. 2. The plug 31 is then replaced.

A further feature of this invention resides in the O-rings surrounding the piston head 22. These O rings engage the inside wall of the valve barrel and are resilient to allow for some lateral play of the piston rod 23. By such an arrangement, the ball 25 will be self-centering when moved downwardly onto the conical valve seat 20, such lateral movement to effect self-centering action being possible with the described resilient O-rings.

OPERATION

In the operation of the valve, the compressive force exerted by the spring 27 on the piston 22 and thus on the ball 25 against the valve seat is adjusted to a desired value by means of the threaded member 29. After appropriate adjustment has been made, the stop means additional piston 28 is secured as by the set screw 30.

The entire valve barrel 15 supported on the adapter 17 is then inserted into a pipe section such as the pipe section 10 and the adapter threaded to the lower end of the pipe section. The next lower pipe section is then secured to the lower threaded portion of the adapter 17 as illustrated in FIG. 1, the valve barrel 15 for the internal valve being coaxially supported within the pipe section 10.

Treating fluid passed through the pipe string 11 will fill the annulus 16 between the valve barrel 15 and inside wall of the pipe section. By building up the pressure of this fluid, a predetermined pressure will be reached wherein the differential force acting on the piston 22 because of the difference in the areas of the valve seat and underside of the piston is greater than the predetermined force exerted by the spring 27. In this respect, the hydraulic force acting on the valve 25 tending to hold it onto the seat 20 is indicated by the arrow F2 whereas the hydraulic force on the underside of the piston 22 is indicated by the arrow F3.

When the net force F3 minus F2 is greater than the force F1 exerted by the spring 27, it will be appreciated that the valve 25 will lift from the valve seat.

Upon initial lifting of the valve 25, fluid in the annulus 16 can then pass around the ball and through the valve seat and into the reduced diameter bore 18 and thence out the lower end of the pipe string to treat the perforations. This flow of fluid around the ball and through the reduced diameter bore 18 is restricted to a certain extent since the area of the valve seat is smaller than the area of the annulus and the bore 18 so that pressure will build up again to act on the underside of the piston 22 and hold the ball in its fully off position from the seat. In other words, when the hydraulic pressure normally acted on the ball indicated by the force F2 is eliminated upon initial unseating of the ball, the ball will snap to its fully open position in a toggle-like manner because of the presence of the hydraulic pressure on the underside of the piston 22.

So long as the hydraulic pressure is maintained on the treating fluid, it will pass down the pipe string through the lateral openings to treat the perforations.

When the hydraulic pressure of the treating fluid is decreased to a value below a predetermined value, the force F1 exerted by the spring 27 will reseat the ball on the valve seat A1 and once the ball is reseated, there will be added to the force of the spring holding the ball on the seat the hydraulic pressure F2 of the fluid in the pipe string on the ball.

With the valve closed, the fluid will be retained in the pipe string and various other operations such as adding further pipe sections can be carried out.

It will be appreciated that should the O-rings on the piston 22 fail or should the force exerted by the spring 27 fail, the hydraulic pressure will act on the ball 25 and also on the top side of the piston since it will pass into the area between the upper additional piston 28 and movable piston 22 to hydraulically hold the ball seated on the valve seat. In other words, there is a "failsafe" condition.

It will thus be apreciated from all of the foregoing, that the present invention provides a greatly improved internal control valve for controlling fluid utilized in oil well remedial operations. Not only is a "failsafe" condition realizable by virtue of having the ball on the upstream side of the fluid flow, but in addition a constant and well defined fluid flow occurs because of the "toggle-like manner" in which the ball is opened and closed. Finally, the provision of the simple adapter for supporting the valve barrel within a normally used pipe section avoids the possibility of increasing the diameter of any section of the pipe string.

After all treating operations have been completed and it is desired to pull the pipe string, a fishing tool can be dropped down the string and engage the valve barrel about a reducted diameter external portion defining a "fishing shoulder" as indicated at FS in FIG. 2. The valve can then be withdrawn upwardly thereby dumping the fluid through the adapter bore 18 and facilitating pulling the pipe without having to lift the fluid. The "fished" valve can be used again in another pipe string with another adapter if desired.

I claim:

1. An internal control valve for use in a pipe section of a pipe string through which special fluid is passed for treating well casing perforations in oil well remedial operations, said internal control valve including, in combination:

(a) an adapter collar threadedly receivable between the lower end of said pipe section and the upper end of the next normally provided pipe section in said string, said adapter having a central reduced diameter bore;

(b) a valve seat having a lower opening communicating with said reduced diameter bore and having an upper opening for communication with the interior of said pipe section;

(c) a ball seated on said valve seat so as to be on the upstream side of any fluid flow from the interior of said pipe section through said valve seat and adapter to the remaining lower pipe sections; and (d) means connected to said ball and responsive to a fluid pressure in said pipe section exceeding a predetermined value to lift said ball from said seat, whereby special treating fluid can be forced down through said pipe string at a pressure exceeding said predetermined pressure to pass through said valve for treating perforations in said well casing, said valve closing when said pressure applied to the treating fluid is reduced below said predetermined value, so that fluid in the said pipe section and other pipe sections thereabove is held when connecting further pipe sections.

2. An internal control valve for use in a pipe section of a pipe string through which special fluid is passed for treating well casing perforations in oil well remedial operations, said internal control valve including, in combination:

(a) an elongated valve barrel having upper and lower ends and of a diameter to be coaxially received within said pipe section and define an annulus between the inner wall of said pipe section and the outer wall of said barrel;

(b) an adapter collar threadedly receivable between the lower end of said pipe section and the upper end of the next normally provided pipe section in said string, said adapter having a central reduced diameter bore tapered at its upper end to receive said lower end of said barrel so that said annulus is closed off at the lower end of said barrel and pipe section, and said barrel is coaxially supported within said pipe section by said adapter;

(c) a valve seat in the lower end of said barrel facing upwardly and communicating at its lower end with said reduced diameter bore in said adapter;

(d) a stop means in the upper end of said barrel;

(e) a piston in a lower portion of said barrel above said valve seat having a piston rod extending downwardly from said piston and terminating in a ball for seating in said valve seat, the cross sectional area of said valve seat being less than the cross sectional area of the underside of said piston, the wall of said barrel between said piston and valve seat having lateral openings communicating with said annulus so that when said ball is seated, communication between said annulus and the remaining lower pipe string sections by way of said reduced diameter bore in said adapter is closed off; and (f) a compression spring in said barrel between said stop means and said piston urging said piston and piston rod downwardly with a given predetermined force whereby remedial treating fluid can be forced down said pipe string with a give pressure sufficient to provide a differential force on said piston greater than the predetermined force of said spring to unseat said ball, said ball then snapping upwardly in a toggle like manner after initial lifting because of the loss of hydraulic force tending to hold the ball seated on said valve seat so that unimpeded flow can take place through the valve, and whereby the pressure of the treating fluid can be decreased to permit said spring to close said valve and thereby hold treating fluid in the pipe while connecting additional pipe.

3. An internal control valve according to claim 2, in which said stop means includes an additional piston sealing the upper end of said barrel from communication with the annulus, and a threaded member received in said upper end and bearing against said piston so that the position of said stop means can be adjusted to change said predetermined compression force holding said ball on said valve seat, whereby adjustments can be made for proper operation of said valve depending upon the particular remedial operations to take place.

4. An internal control valve according to claim 3, in which there is provided a lubricating fluid between said first mentioned and additional pistons in said barrel for lubricating movement of said first mentioned piston.

5. An internal control valve according to claim 4, including a reduced diameter portion formed in the exterior wall of the upper end portion of said valve barrel defining a "fishing shoulder" to enable said valve to be removed from the pipe string prior to pulling the string.

* * * * *